US012729445B2

(12) United States Patent
Headen-Morris

(10) Patent No.: US 12,729,445 B2
(45) Date of Patent: Sep. 8, 2026

(54) CYLINDER PROCESSING DEVICE

(71) Applicant: FHM Investments Ltd, Oldham (GB)

(72) Inventor: Frank Thomas Headen-Morris, Oldham (GB)

(73) Assignee: FHM Investments Ltd, Oldham (GB)

( * ) Notice: Subject to any disclaimer, the term of this patent is extended or adjusted under 35 U.S.C. 154(b) by 247 days.

(21) Appl. No.: 18/429,991

(22) Filed: Feb. 1, 2024

(65) Prior Publication Data

US 2024/0263316 A1 Aug. 8, 2024

(30) Foreign Application Priority Data

Feb. 2, 2023 (GB) ..... 2301513

(51) Int. Cl.
*C23G 3/04* (2006.01)

(52) U.S. Cl.
CPC ..... *C23G 3/04* (2013.01)

(58) Field of Classification Search
None
See application file for complete search history.

(56) References Cited

U.S. PATENT DOCUMENTS 4,124,112 A * 11/1978 Mohney ..... B65G 47/847 198/479.1

FOREIGN PATENT DOCUMENTS

CN 109540425 A 3/2019
CN 109540426 A * 3/2019 ..... G01M 3/329
(Continued)

OTHER PUBLICATIONS

English Machine Translation of CN-109540426-A (Year: 2019).*
(Continued)

*Primary Examiner* — Kaj K Olsen
*Assistant Examiner* — Pradhuman Parihar
(74) *Attorney, Agent, or Firm* — Jeffer Mangels & Mitchell LLP; Brennan C. Swain, Esq.

(57) ABSTRACT

A processing apparatus for a plurality of cylinders that includes a superstructure having a support frame and a rotary structure mounted to the support frame for rotation about a rotational axis. The rotary structure includes a plurality of cylinder stations, angularly spaced about the rotational axis, each configured, in use, to receive a cylinder a plurality of restraining arms, each restraining arm corresponding to a respective cylinder station, and a locking mechanism coupled to the plurality of restraining arms. Each restraining arm is moveable between a closed configuration and an open configuration. In the closed configuration the restraining arm contacts a cylinder received on the corresponding cylinder station to restrain the cylinder on the cylinder station. In the open configuration, the restraining arm is retracted away from said cylinder received on the corresponding cylinder station such that a cylinder can be removed from the cylinder station or placed on the cylinder station. The locking mechanism has an unlocked configuration and a locked configuration. In the unlocked configuration movement of the plurality of restraining arms between said closed and open configurations is possible. In the locked configuration, movement of the plurality of restraining arms from said closed configuration to said open configuration is prevented by the locking mechanism.

22 Claims, 5 Drawing Sheets

(56) References Cited

FOREIGN PATENT DOCUMENTS

| | | | |
|---|---|---|---|
| GB | 3943426 | A1 | 1/2022 |
| JP | 2011-241027 | A | 12/2011 |

OTHER PUBLICATIONS

Search Report under Section 17—Application No. GB2301513.4—Intellectual Property Office of the United Kingdom—dated Jul. 14, 2023.
Search Report issued in EP 24155609.1 (Dated May 28, 2024).

* cited by examiner

CYLINDER PROCESSING DEVICE

TECHNICAL FIELD

The present invention relates to an apparatus and method for the processing of cylinders. In particular, the apparatus may be a rotating bed apparatus configured for processing thin-walled cylinders, for example hot water storage tanks.

BACKGROUND

Hot water storage tanks are often of welded stainless steel construction. This necessitates further processing of the as-welded cylinders to test the cylinder properties or to treat the cylinder so to induce a set of desired properties. In an example, the cylinders may be subject to hydrostatic testing to assure their water tightness and/or structural integrity. In another example, the cylinders may also be subject to chemical cleaning, for example a pickling treatment to remove corrosion-prone heat-affected zones left by welding operations during fabrication.

In general, processing of cylinders may be carried out on a rotating bed apparatus or on static fixtures on a production facility floor. Static fixtures occupy a large amount of floor space per cylinder being processed. In a rotating bed apparatus, the cylinders rest on beds comprised of multiple stations which rotate, resulting in a smaller footprint. The rotation of the cylinders necessitates the provision of an arrangement for securing the cylinders to the apparatus. Cylinders are conventionally secured by straps passing around a part of, or the whole of, the cylinder circumference. Each cylinder may be secured by two straps, with longer cylinders necessitating three or more straps. Such a strap-based arrangement requires manual intervention by an operator for each cylinder when loading and unloading cylinders from the rotating-bed apparatus. Manually securing and un-securing each individual cylinder on a cylinder bed is time-consuming, reducing the rate at which cylinders can be processed. Furthermore, given that the straps require manual intervention by an operator there is the possibility that a cylinder will not be properly secured due to user error.

It is an object of the present invention to provide a processing apparatus for a plurality of cylinders and method which overcomes or mitigates a problem associated with the prior art, whether discussed herein or otherwise. It is a further object of the present invention to provide an alternative processing apparatus for a plurality of cylinders and method.

SUMMARY OF INVENTION

According to a first aspect there is provided a processing apparatus for a plurality of cylinders, the processing apparatus comprising: a superstructure comprising a support frame; a rotary structure mounted to the support frame for rotation about a rotational axis, the rotary structure comprising a plurality of cylinder stations, angularly spaced about the rotational axis, each configured, in use, to receive a cylinder; a plurality of restraining arms, each restraining arm corresponding to a respective cylinder station, wherein each restraining arm is moveable between: a closed configuration in which, in use, the restraining arm contacts a cylinder received on the corresponding cylinder station to restrain the cylinder on the cylinder station; and an open configuration in which, in use, the restraining arm is retracted away from said cylinder received on the corresponding cylinder station such that a cylinder can be removed from the cylinder station or placed on the cylinder station; and a locking mechanism coupled to the plurality of restraining arms, the locking mechanism having: an unlocked configuration in which movement of the plurality of restraining arms between said closed and open configurations is possible; and a locked configuration in which movement of the plurality of restraining arms from said closed configuration to said open configuration is prevented by the locking mechanism.

Advantageously, the present invention reduces the time required to secure and unsecure each individual cylinder during loading and unloading of a processing apparatus by allowing the cylinder restraining arms to be locked and unlocked without manual intervention by an operator. Furthermore, given that manual intervention to secure each cylinder is not required, the risk of a cylinder not being adequately secured is reduced.

The processing apparatus may have one of 2, 3, 4, 5, 6, 7, 8, 9, 10, 11, 12, 13, 14, 15 or 16 cylinder stations.

The cylinder stations may be grouped to form a number of beds, for example four beds. Accordingly, the present invention may also be referred to as a rotating bed processing apparatus.

Advantageously, the provision of multiple cylinder stations allow the simultaneous processing of multiple cylinders.

The rotary structure may further comprise a rotary frame, supporting the cylinder stations.

Advantageously, the rotary frame allows the transmission of rotary motion to the cylinder stations. The rotation of the cylinder stations (and hence, in use, cylinders) may be advantageous depending on the type of processing that is being carried out on the cylinders.

The plurality of restraining arms may be coupled to the rotary frame.

Advantageously, the coupling of the plurality of restraining arms to the rotary frame allows each restraining arm to better support the weight of each cylinder. Furthermore, it allows each cylinder station to have a cylinder loaded to it and unloaded from it individually.

The movement of the plurality of restraining arms between said closed and open configurations may comprise a rotation.

The movement of the plurality of restraining arms between said closed and open configurations may comprise a linear motion.

The locking mechanism may further comprise one or more locking transducers.

Advantageously the provision of a locking transducer allows the locking mechanism to be remotely engaged into a locked configuration or remotely disengaged into an unlocked configuration.

Each of the one or more locking transducers may be coupled to two or more restraining arms.

In an alternative, each of the plurality of restraining arms may be coupled to a single locking transducer.

Advantageously, coupling multiple restraining arms to a one or more locking transducers allows multiple restraining arms to be simultaneously locked in a closed configuration or unlocked.

Each of the plurality of restraining arms exerts a restraining force on a cylinder received, in use, on the respective cylinder station, when the locking mechanism is in the locked configuration; wherein the restraining force may be less than a buckling force of the cylinder.

The restraining force may be alternatively expressed as being not substantially in excess the weight of each cylinder at any rotational orientation of the rotary structure, and hence cylinder.

Advantageously, the above-described restrictions on the force exerted by the restraining force of the restraining arms minimize the likelihood of damage to the cylinders through buckling or otherwise.

The processing apparatus may be configured to carry out hydrostatic testing on said plurality of cylinders.

The processing apparatus may further comprise a hydrostatic testing module, said hydrostatic testing module comprising: filling apparatus configured to be secured to at least one opening of each cylinder and to introduce water into each cylinder and pressurize said introduced water; and a pressure monitoring apparatus configured to measure a pressure within each of said plurality of cylinders when filled with said introduced water.

A rotating bed processing apparatus for hydrostatic testing of cylinders allows hydrostatic testing to be carried out in an enclosed, compact footprint.

The processing apparatus may be configured to carry out pickling operations.

The processing apparatus may also be configured to carry out chemical cleaning operations, other than pickling.

A rotating bed processing apparatus for pickling of cylinders reduces the footprint required per cylinder for pickling reduces the necessary manual handling by operators. In addition, the rotary motion of the apparatus induces a degree of agitation to any contents of the cylinders.

Each restraining arm may include a filling portion configured to inserted, in use, into one or more openings provided in the cylinder located on the respective cylinder station, wherein the filling portion is configured to provide a fluid connection to a source of pickling fluid, so as to introduce pickling solution into the cylinder.

Advantageously, the provision of a filling portion on each restraining arm minimises the manual operations required to prepare the cylinders for pickling. This further reduces the exposure of operators to the potentially hazardous pickling process.

Each restraining arm may comprise a main body and a yoke located at a distal end of the main body, the yoke being configured to contact at least a portion of an outer surface of a cylinder received on the respective cylinder station when the restraining arm is in the closed configuration.

The yoke of each restraining arm may be pivotally mounted to the main body.

The provision of a pivotally-mounted yoke at a distal end of the restraining arm main body advantageously allows a rotating bed processing apparatus to secure a variety of cylinder sizes and geometries.

The locking mechanism may enter the unlocked configuration from the locked configuration when energised.

The locking mechanism may passively adopt the locked configuration on de-energisation.

Advantageously, when power is lost through outage or breakdown, the locking mechanism passively locks, preventing damage to the cylinders and/or adjacent operators and objects through inadvertent release.

According to a second aspect of the invention, there is provided a method of carrying out a processing operation on a plurality of cylinders using a processing apparatus, the processing apparatus comprising: a superstructure comprising a support frame; a rotary structure mounted to the support frame, the rotary structure comprising a plurality of cylinder stations, angularly spaced about a rotational axis, and a plurality of restraining arms, each restraining arm corresponding to a respective cylinder station, and a locking mechanism coupled to the plurality of restraining arms. Wherein the method comprises: rotating the rotary structure relative to the support frame about the rotational axis, receiving a cylinder on each cylinder station; moving each restraining arm between: a closed configuration in which, in use, the restraining arm contacts a cylinder received on the corresponding cylinder station to restrain the cylinder on the cylinder station; and an open configuration in which, in use, the restraining arm is retracted away from said cylinder received on the corresponding cylinder station such that a cylinder can be removed from the cylinder station or placed on the cylinder station; changing the state of the locking mechanism between: an unlocked configuration in which movement of the plurality of restraining arms between said closed and open configurations is possible; and a locked configuration in which movement of the plurality of restraining arms from said closed configuration to said open configuration is prevented by the locking mechanism; carrying out a processing operation on each cylinder.

The state of the locking mechanism may be put in the locked configuration in one or both of the open and closed restraining arm configurations. Conversely, the state of the locking mechanism may be put in the unlocked configuration in one or both of the open and closed restraining arm configurations.

Advantageously, the method reduces the time required to secure and un-secure each individual cylinder during loading and unloading of a processing apparatus by locking and unlocking the restraining arms without manual intervention by an operator. Furthermore, by reducing the operator intervention required to secure the cylinders to the cylinder stations, the risk of the cylinders being incorrectly secured to the cylinder stations is reduced.

The processing apparatus may further comprise: a hydrostatic testing module, the hydrostatic testing module comprising filling apparatus for the plurality of cylinders and a pressure monitoring apparatus for each of said plurality of cylinders; wherein the method may further comprise: securing the filling apparatus to at least one opening of each cylinder; the filling apparatus introducing water into each cylinder; the filling apparatus pressurising said introduced water; the pressure monitoring apparatus measuring a pressure within each of said plurality of cylinders, when water has been introduced into each cylinder and pressurized, over a period of time; draining the water from the cylinder.

The processing apparatus may further comprise a filling portion, coupled to each restraining arm; wherein the method further comprises: inserting each filling portion into one or more openings provided in a cylinder located on the respective cylinder station; providing a fluid connection between each filling portion and a source of pickling fluid; introducing pickling solution from the source of pickling solution into each cylinder via the respective filling portion and said fluid connection; allowing the pickling solution to react with each cylinder, whilst the rotary structure is rotated to agitate said introduced pickling solution; draining the pickling solution from each cylinder.

The method may further comprise loading each of the plurality of cylinders, so as to be received by the respective cylinder station, whilst the respective restraining arm is in the open configuration.

The method may further comprise unloading each of the plurality of cylinders from the respective cylinder station, whilst the respective restraining arm is in the open configuration.

BRIEF DESCRIPTION OF DRAWINGS

Several embodiments of the disclosure will now be described by way of example only and with reference to the accompanying drawings, in which.

DETAILED DESCRIPTION

Figure 1A:
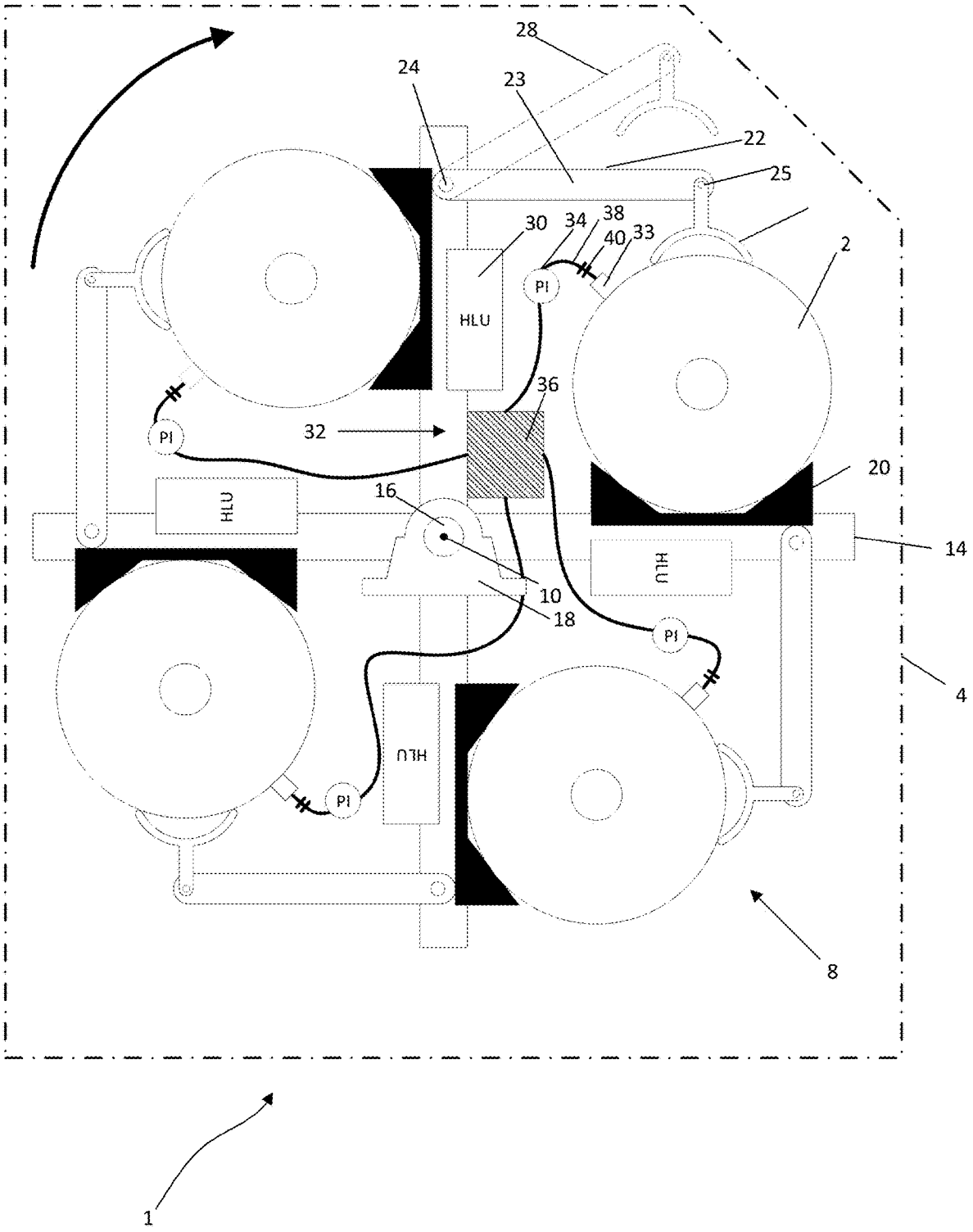
FIGS. 1A and 1B are simplified schematic illustrations of a cylinder processing device according to an embodiment of the invention, having a four-bed spindle configuration, viewed in the axial and radial direction, respectively.
Figure 1B:
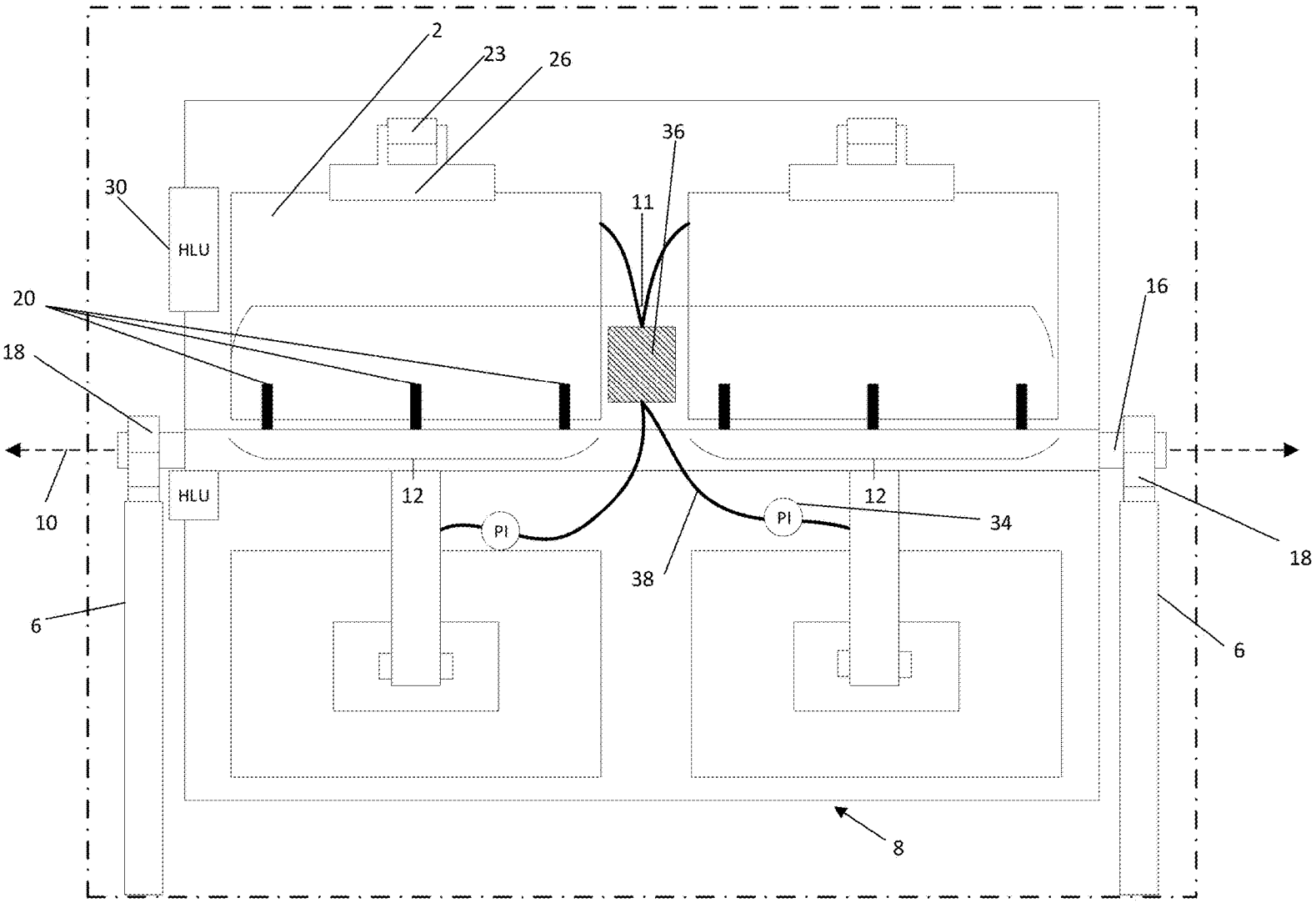

FIG. 1A and FIG. 1B are simplified schematic illustrations of a processing apparatus 1 for a plurality of cylinders 2, viewed in an axial and a radial direction, respectively. The processing apparatus comprises a superstructure 4, itself comprising a support frame 6, and a rotary structure 8, which may also be referred to as a spindle. The rotary structure 8 is mounted to the support frame 6 for rotation about a rotational axis 10. In order to facilitate the relative rotation between the rotary structure and the support structure, the support structure may comprise one or more bearing arrangements which receive one or more corresponding axles of the rotary structure, or vice versa. As will be appreciated by the person skilled in the art, any appropriate configuration may be used to achieve relative rotation between the rotary structure and the support structure. The rotary structure 8 comprises a plurality of cylinder stations 12, angularly spaced about the rotational axis 10 in four beds 11, each bed comprising two cylinder stations 12. The beds 11 are equally spaced at 90 degrees from each other. For the avoidance of doubt, by angularly spaced, what is meant is that there is an angular separation or spacing, about the rotation axis (of the rotary structure), between each of the cylinder stations. In particular, a centre of each cylinder station may be angularly spaced from a centre of each other cylinder station.

Please note that in FIGS. 1A, 1B and elsewhere, identical instances of the same features are labelled only in selected instances in the interests of clarity. That is to say, where a plurality of similar features are shown in a figure, only one of the similar features may be labelled.

The rotary structure comprises a plurality of cylinder stations which are supported by a rotary frame 14, which may also be known as a spindle steel structure, coupled rotatably to the superstructure 4 by a shaft 16. The shaft 16 is supported at a first and second end by a pair of bearing blocks, 18 in FIGS. 1A and 1B. The bearing blocks 18 are rigidly coupled to the support frame. The support frame 6 (omitted for clarity in FIG. 1A) locates and supports the bearing blocks 18 and hence the shaft 16, and thus the rotational axis 10, such that there is sufficient clearance for the rotary structure 8 to rotate.

In the following section, reference will be made primarily to one portion of the apparatus comprising one row (or bed) of cylinder stations. It will be appreciated that the processing apparatus is composed of multiple substantially structurally and functionally similar portions or beds (note the rotational symmetry of rotary structure 8), of which the presently-referenced portion is only a single instance. That is to say, whilst the functioning of one of the portions or beds of the apparatus is described, the other angularly (or rotationally) spaced portion function in substantially the same manner.

Each of the plurality of cylinder stations 12 is each configured, in use, to receive a cylinder. The cylinder stations comprise a row of supports 20, disposed along the axial or Z-direction. Each support 20 makes at least two points of contact with a cylinder 12 at rest—that is to say, each support contacts its supported cylinder at at least two separate points around the circumference of the outer surface of the supported cylinder. The supports 20 may also be referred to as support saddles.

It will be appreciated that, given that the cylinder stations rotate about the rotary axis as part of the rotary structure, in order to secure the cylinder 2 in all orientations of the rotary structure 8 with respect to gravity, the azimuth angle (about an axis of the cylinder, which is parallel to the rotary axis) between each neighbouring pair of points of contact must be less than 180 degrees. Therefore, one or more further points of contact are required (namely, at least three points of contact in total).

Coupled to the rotary frame 14 are a plurality of restraining arms 22*a-d*, each restraining arm corresponding to, and offset from a respective cylinder station. Each restraining arm 22*a-d* comprises a main body 23*a-d* and yoke 26*a-d*. A proximal end of each main body 24*a-d* is pivotally coupled to the rotary 14 frame. At a distal end 25*a-d*, each main body 24*a-d* is pivotally connected to a respective generally saddle-shaped yoke 26*a-d*.

Each restraining arm 22 is rotatable about the proximal end between closed and open configurations. FIG. 1 shows the restraining arms 22 in the closed configuration In the closed configuration, in which the restraining arm 22 contacts a cylinder received on the corresponding cylinder station 12 by means of the yoke 26. The yoke 26 is configured to provide two additional points of contact as required to restrain or secure the cylinder 2 in all orientations with respect to gravity. However, it will be appreciated that in other embodiments, the yoke may contact its respective cylinder at one or three or more points of contact.

In the open configuration, shown in dashed lines as 28 for one of the restraining arms in FIG. 1A, the restraining arm is retracted away from the cylinder 2 received on the corresponding cylinder station 12. In the open configuration the cylinder 2 is subject only to two points of contact (as provided by the cylinder station), such that the cylinder can be removed from the cylinder station 12. Alternatively, if there is no cylinder located on the cylinder station, when the restraining arm is in the open position, there is a sufficient clearance between the cylinder station and restraining arm (and, in particular, the yoke of the restraining arm) such that a cylinder can be mounted or inserted onto the cylinder station.

The plurality of restraining arms 22 are coupled to a respective set of hydraulic locking units 30, each configured to selectively engage and disengage a locking mechanism between locked and unlocked configurations, respectively. The hydraulic locking units (HLUs) 30 are configured to passively disable or inhibit restraining arm 22 movement on de-energisation. The details of the coupling/linkage between the plurality of restraining arms 22, the rotary frame 14 and the HLUs 30 will be described later with reference to FIG. 2.

The locking mechanism may itself comprise one or more locking transducers. A HLU may comprise a hydraulic piston in fluid connection with a reservoir via electromagnetically-operated check valve. On de-energisation, in the locked configuration of the locking mechanism, the check valve automatically restricts flow of hydraulic fluid, preventing axial movement of the piston within its cylinder bore. When the check valve is energised, in the unlocked configuration of the locking mechanism, the check valve permits flow of hydraulic fluid between the piston and fluid reservoir such that movement of the piston within its cylinder bore is permitted.

In the unlocked configuration, movement of the plurality of restraining arms 22 between the above-described closed and open configurations is possible or permitted. In the locked configuration, movement of the plurality of restraining arms 22 from said closed configuration to said open configuration is prevented by the locking mechanism of the HLU 30. Each of the plurality of restraining arms is mechanically linked to the HLU piston, locking the HLU prevents movement of the HLU piston and thus also the plurality of restraining arms.

As previously discussed, in the present embodiment, the cylinder stations are arranged into beds of two (i.e. two individual stations to a bed length). Given that each cylinder station has its own respective restraining arm, each bed of cylinder stations has two associated restraining arms. In the presently-described embodiment, each HLU 30 is configured to restrict the movement of both restraining arms for a respective bed 11 when engaged in the locked configuration.

Examples of processes which may be carried out on the cylinders 2 whilst restrained on the rotating cylinder stations include chemical cleaning (e.g. pickling) and hydrostatic testing. Pickling and hydrostatic testing processes are well-known to the person skilled in the art—in the interests of brevity, details of these processes are therefore omitted.

The present embodiment, described with reference to FIGS. 1A and 1B, is suitable for hydrostatic testing of the cylinders 2. The processing apparatus 1 further comprises a hydrostatic testing module, itself comprising filling apparatus 32 and a pressure monitoring apparatus 34. The filling apparatus 32 is configured to be secured to at least one opening 33 of each cylinder 2 and to introduce water into each cylinder 2 and pressurize said introduced water. The filling apparatus comprises a source of water and pressure 36 as well as hoses 38 with fluid connectors 40 capable of sealingly interfacing with, and/or being secured to, one of said openings 33 in a cylinder 2. The hoses 38 are connected to the source of water and pressure 36. The pressure monitoring apparatus 34 is configured to measure a pressure within each of said plurality of cylinders 2 when filled with said introduced water, for example by means of an electronic pressure indicator.

In use, each of the plurality of cylinders 2 is loaded into the processing apparatus 1 so as to be received by the respective cylinder station 12, while the respective restraining arm 22 is in the open configuration. The locking mechanism of the HLU 30 may be engaged or disengaged.

The restraining arm 22 is then moved into closed configuration (in which, preferably, the yoke of the restraining arm contacts the cylinder) and the locking mechanism of the HLU 30 engaged into the locked configuration.

The connectors of the filling apparatus are connected to the respective opening 33 in each of the plurality of cylinders. Other openings may be present in each of the plurality of cylinders 2 and these need to be sealed before water is introduced into each cylinder 2.

The rotary structure 8 is then set in rotational motion (for example, by a motor) whilst some or all of the cylinder processing occurs. The filling apparatus introduces water via the hoses 38 and their connectors 40 into each respective cylinder and pressurises the introduced water.

The pressure monitoring apparatus 34 measures the pressure within each cylinder 2 over a predetermined time period. Any decrease in the measured pressure over time indicates the presence of a faulty non-watertight cylinder. The introduced water in each of the plurality of cylinders 2 can be drained, and, possibly, reused, once pressure measurement and/or testing is complete.

On completion of the processing steps, the rotation of the rotary structure 8 may be suspended and the locking mechanism of HLU 30 disengaged into the unlocked configuration. The restraining arms 22 are then retracted into the open configuration.

Each of the plurality of (now-processed) cylinders 2 is unloaded from the processing apparatus 1, while the respective restraining arm 22 is in the open configuration. The locking mechanism may be engaged or disengaged.

In the present method cylinders to be processed may be inserted on to the cylinder stations of a first bed of cylinder stations. Subsequently the rotary structure may be rotated and cylinders to be processed may be inserted on to the cylinder stations of a second bed of cylinder stations, which are angularly spaced from the first bed of cylinder stations, and so on. The unloading of processed cylinders from each bed of cylinder stations may also happen in a similar sequential manner, prior to the cylinders to be processed being received in the relevant cylinder stations of the relevant bed of cylinder stations.

Figure 3:
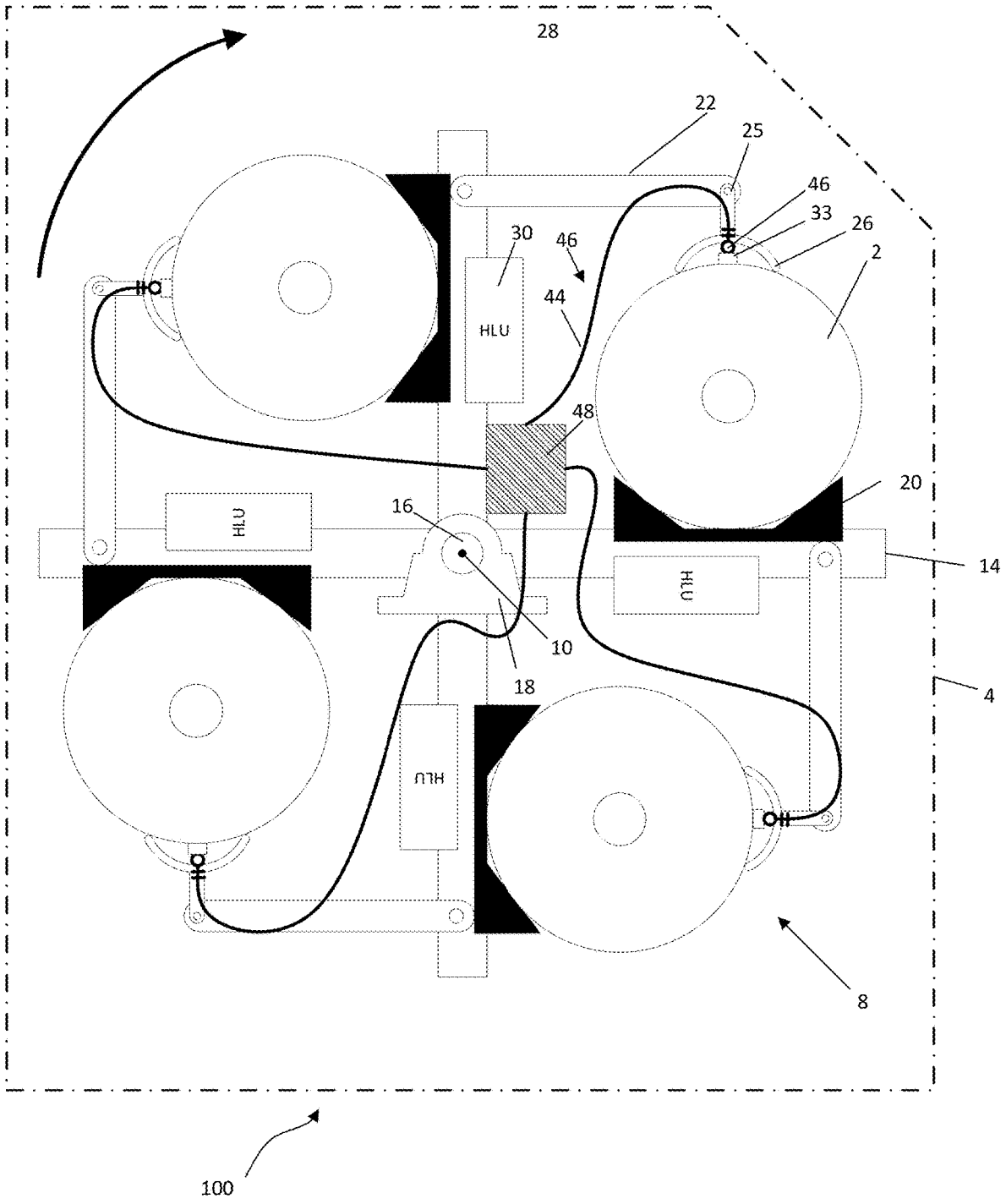
FIG. 3 schematically illustrates an alternative embodiment of the present invention, also having a four-bed spindle configuration, viewed in the axial direction.

Briefly turning to FIG. 3, which is a schematic axial-view illustration of a processing apparatus 100 suitable for pickling of a plurality of cylinders 2. It will be appreciated that processing apparatus 100 is very similar to processing apparatus 1 described above, differing only in details relating to the specific processing operation of pickling. Accordingly, like numerals refer to like (i.e. identical/analogous) components. Processing apparatus 100 comprises a plurality of filling portions 42 coupled to each restraining arm 22. The filling portions 42 are each configured to inserted, in use, into an opening 33 provided in each cylinder 2 located on the respective cylinder stations 12. Each filling portion comprises a hose 44 and a connector or nozzle 46 coupled to the yoke 26 of respective restraining arm 22. The filling portions 42 are configured such that, provided each cylinder is correctly positioned on its respective cylinder station, each nozzle 46 automatically engages with the opening 33 in each respective cylinder 2 as the restraining arm moves to the closed configuration. The aforementioned engagement creates fluid communication between an attached source of pickling solution 48 and the plurality of cylinders 2, so as to introduce pickling solution into the cylinder.

In use, each of the plurality of cylinders 2 is loaded into the processing apparatus 100 so as to be received by the respective cylinder station 12, while the respective restraining arm 22 is in the open configuration. The locking mechanism of the HLU 30 may be engaged or disengaged.

The restraining arm 22 is then moved into closed configuration, such that the connectors 46 engage with the opening 33 in each respective cylinder 2, preferably in a sealing relationship. Once in the closed configuration, the locking mechanism of the HLU 30 is engaged into the locked configuration. Other openings may be present in the plurality of cylinders and are left open to assist in draining the cylinder 2 of chemicals and water. Pickling solution is introduced from the attached source of pickling solution 48 into each cylinder via the respective filling portion and said fluid connection.

The rotary structure 8 is then set in rotational motion (for example, by a motor) whilst some or all of the cylinder pickling occurs. In the processing apparatus for the rotation of the rotary structure 8, and by extension the cylinder stations 12, induces agitation of the pickling fluid, aiding the pickling process reactions.

On completion of the pickling process, the (spent) pickling solution may be drained from each of the cylinders 2 and, possibly, reused. The above-described cycle may be repeated with water instead of pickling solution to remove residual chemicals and/or acid. The rotation of the rotary structure 8 may be terminated and the locking mechanism of HLU 30 disengaged into the unlocked configuration. The restraining arms 22 are then retracted into the open configuration.

Each of the plurality of (now-processed) cylinders 2 is unloaded from the processing apparatus 1, while the respective restraining arm 22 is in the open configuration. The locking mechanism may be engaged or disengaged.

Figure 4:
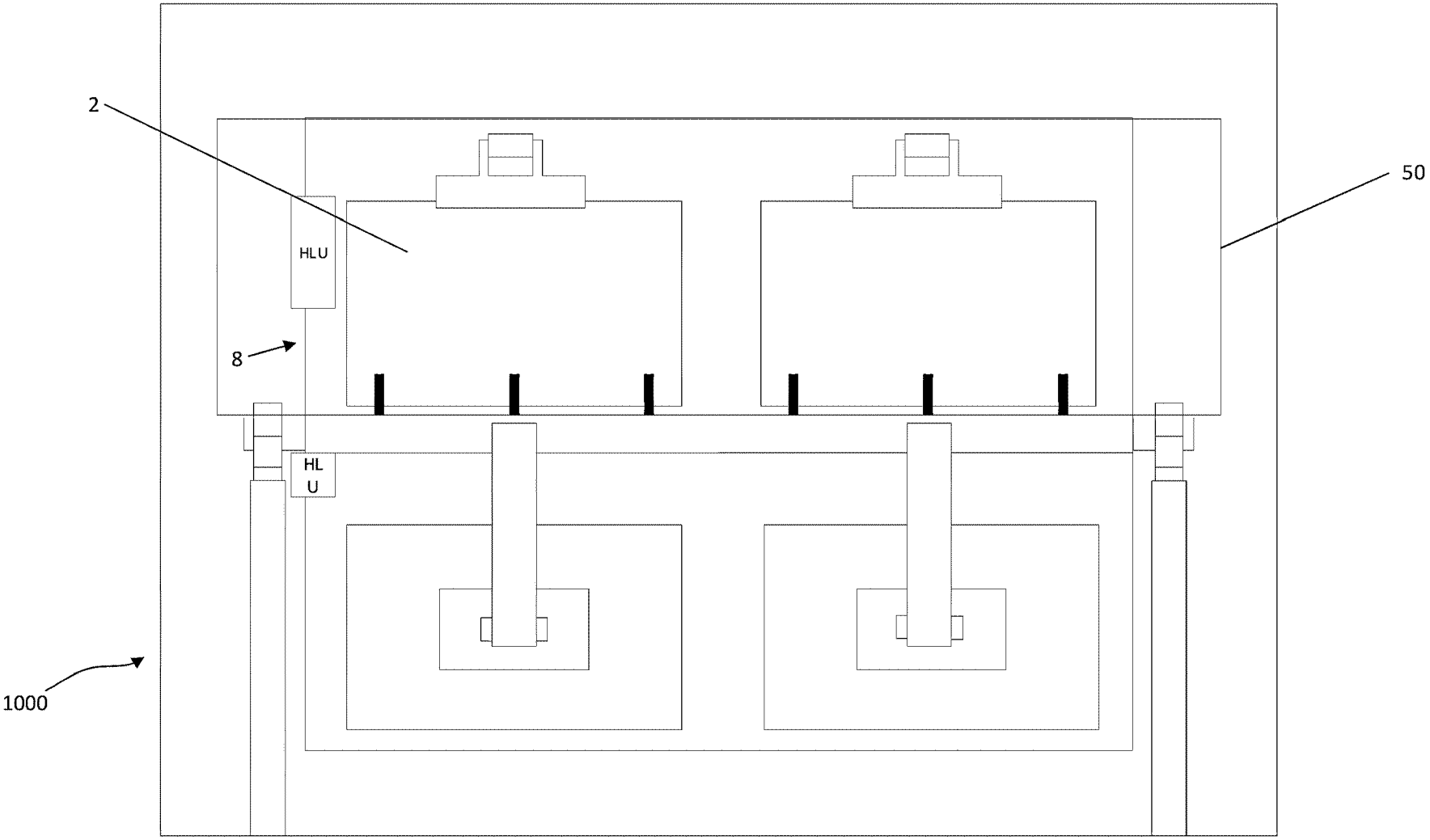
FIG. 4 schematically illustrates another alternative embodiment of the present invention, viewed in the radial direction.

An embodiment of the processing apparatus 1000 having an enclosed superstructure 4 with a closeable/sealable access port is schematically illustrated in FIG. 4. The superstructure 4 defines a substantially enclosed volume containing the remainder of the processing apparatus 1000 and further comprises a closable/sealable access port 50 for loading and unloading cylinders as described above. The enclosed superstructure may act to contain any fluids in use during processing, ensuring process safety. In particular, pickling solutions are typically hazardous corrosive fluids, such as nitric acid. Therefore, enclosing the process so as to prevent splashing and/or contain any leakage or drained pickling fluid is particularly advantageous.

In such embodiments, the HLUs 30 must be controlled such that the open configuration of the restraining arm and unlocked configuration of the locking mechanism may only be adopted by a particular bed 11 and its respective components when adjacent the access port 50. This is may be necessary to ensure that release of the cylinders 2 whilst the relevant cylinder station(s) are adjacent the access port for loading and unloading of cylinders onto/from the relevant cylinder station(s) via the access port. Such operation may be effected, for example, by a commercially-available process logic controller (PLC) and rotational encoders or a position-controlled motor.

In addition, the corrosive nature of pickling solutions may also degrade mechanical components on contact. To this end, the HLUs themselves may enclosed or shielded from the pickling solution by physical barriers and/or positioning away from fluid outlets.

Figure 2:
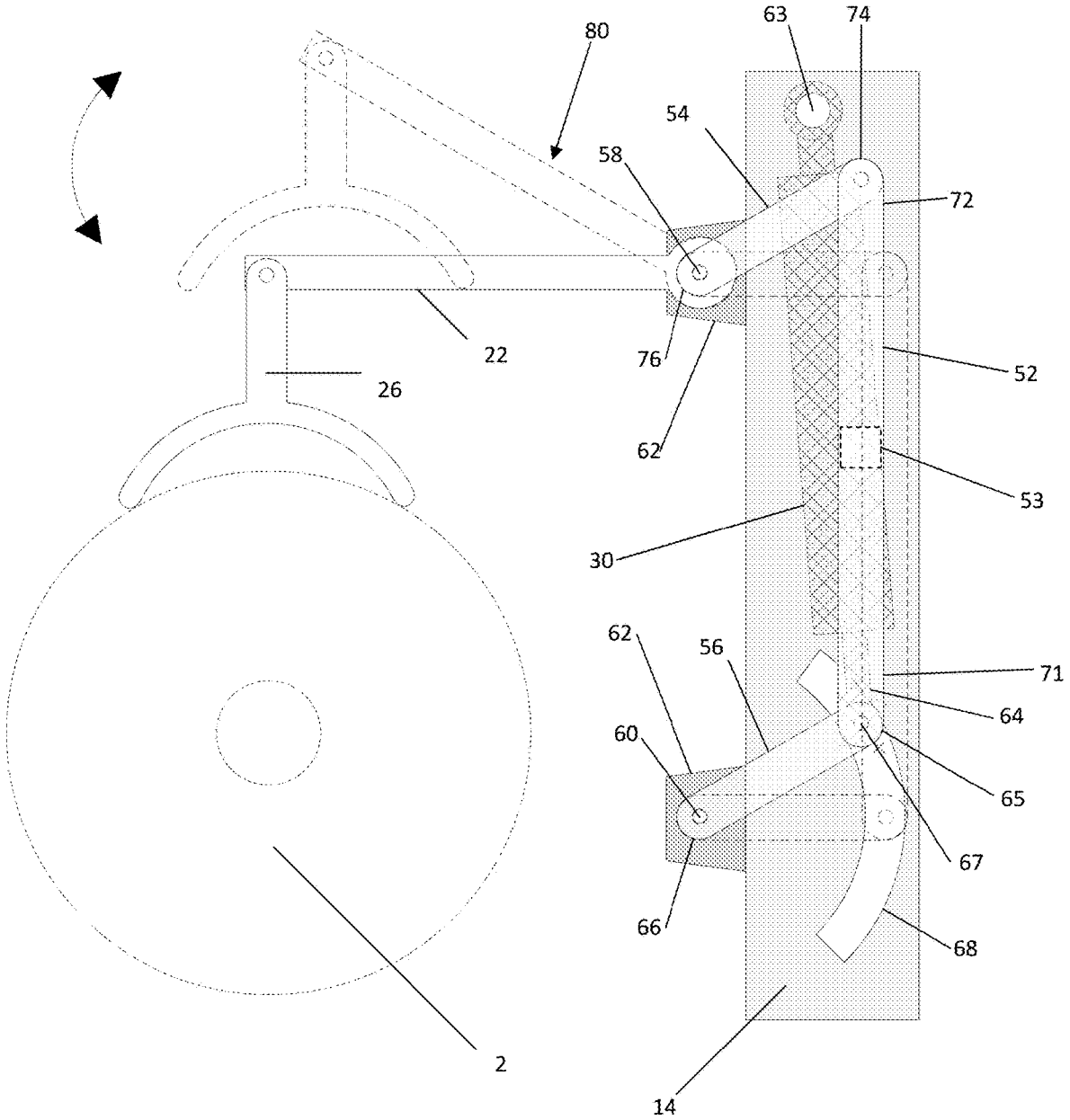
FIG. 2 is a schematic illustration of an embodiment of a restraining arm and its linked components.

FIG. 2 is schematic illustration of an example linkage arrangement between one of the plurality of restraining arms 22, the respective HLU and the rotary frame 14. Please note that the components depicted in FIG. 2 have been rendered partially transparent where appropriate to aid clarity of depicting the operation of the arrangement. The linkage arrangement comprises the HLU 30, the rotary frame 14 (shown in part), the restraining arm 22, coupling rod 52, an upper pivot arm 54 and a lower pivot arm 56. The linkage arrangement also comprises an upper pivot bar 58 and a lower pivot bar 60 which are pivotally coupled to the rotary frame 14 by fixed bearers 62 (rigidly coupled to the rotary frame 14). The upper pivot bar 54 and lower pivot bar 58 may also be referred to as the upper driveshaft and lower driveshaft, respectively.

The HLU 30 is pivotally coupled at a first end 63 to the rotary frame 14 and at a second end 64 to a first end 65 of the lower pivot arm 56. As shown in the figure, the HLU is provided behind the rotary frame 14, so the pivotal coupling of the HLU and lower pivot arm 56 is via an axle 67 passing through a concentric or semi annular slot 68, which facilitates displacement of axle 67 through its rotational locus of motion. The lower pivot arm 56 is rigidly coupled at a second end 66 to the lower pivot bar 60, such that it rotates about the lower pivot bar 60. The first end of the lower pivot arm 65 is also pivotally connected to a first end 71 of the coupling rod 52. A second end 72 of the coupling rod 52 is pivotally connected to a first end 74 of the upper pivot arm 54. The upper pivot arm 54 is rigidly coupled at a second end 76 to the upper pivot bar 58, defining a rotational axis about which the upper pivot arm 54 rotates. The proximal end the restraining arm 22 is also rigidly coupled to the upper pivot bar or driveshaft 58, so that rotation of the upper pivot bar 58, causes the restraining arms 22 to rotate in unison.

The HLU 30 is configured to linearly contract and expand in length (due to, for example, a piston moving along a cylinder bore) in the unlocked configuration, allowing rotation of the lower pivot arm 56 with displacement of the axle 67 and HLU second end 64 about an axis defined by the lower pivot bar 60. The upper pivot arm 54 and lower pivot arm 56 are pivotally coupled by the coupling rod 52, so that they rotate in tandem. Because the upper pivot arm 54 and restraining arm 22 are rigidly coupled to a common pivot bar 58, the restraining arm 22 can be retracted and advanced from the cylinder 2 by rotating the upper pivot arm 54 by expansion and contraction, respectively, of HLU 30.

To better-illustrate the linkage arrangement, a retracted configuration 80 is also shown in the figure in dashed lines.

In the locked configuration, the HLU 30 has a fixed length, restricting the motion of the lower pivot arm 56. This also prevents movement of the upper pivot arm 54, and, in consequence, the restraining arm 22.

It will be noted that any number of restraining arms and HLUs 30 may be coupled to the upper pivot bar 58.

It should be noted that, once locked, the HLU 30 does not actively maintain a contact force, it merely maintains a positional configuration of the restraining arm 22. The forces acting to restrain and/or secure the cylinders 2 comprise the normal contact forces inherent to contact with a rigid body (namely, the restraining arm 22 and supports 20). It is preferable that the aforementioned contact forces should not substantially exceed the weight of each cylinder at any rotational orientation. This reduces the restraining forces on the cylinder to the minimum necessary, reducing the likelihood of buckling and/or crushing the cylinders loaded into processing apparatus 1. Put another way, in a preferred embodiment, the locking mechanism is configured such that, when it is in the locked configuration, at all rotational positions of the rotary structure, the force exerted by the restraining arm on a restrained cylinder is less than a crush or buckling force of the restrained cylinder (such that the restrained cylinder does not experience plastic deformation).

It is will be appreciated by one of ordinary skill in the art that the invention has been described by way of example only, and that the invention itself is defined by the claims. Numerous modifications and variations may be made to the exemplary design described above without departing from the scope of the invention as defined in the claims. For example, the method steps may be performed in a different order and/or the method may comprise additional method steps.

Whilst the above-described embodiments are described as cylinder processing apparatus, it will be appreciated that any geometry of tank in general could be processed, restraining arrangements allowing. For example, tanks of ellipsoidal cross-section or cuboidal geometry may also be processed. Furthermore, the processed components need not be hollow vessels, but may be any suitable generally solid component.

It should also be understood that while processing has only been described for pickling and hydrostatic testing, this is non-limiting and any other process could be carried out on restrained cylinders using the above described method and apparatus.

In the embodiments described above (e.g. with reference to FIGS. 1A and 1B), the processing apparatus has eight cylinder stations with eight corresponding restraining arms arranged in four beds, each bed comprising two (in-line) cylinder stations. In other embodiments, there may be any appropriate number of beds (e.g. 1, 2, 3, 4, 5, 6, 7, 8, 9, 10, 12, 16 etc.) and each bed may have any appropriate number of cylinder stations (e.g. 1, 2, 3, 4, 5, 6, 7, 9, 10, 11, 12, 13, 14, 15, 16 or more). Furthermore, in other embodiments, the number of cylinder stations in each bed need not be the same. Also, the number of restraining arms need not correspond with the number of cylinder stations—for example, each restraining arm could be configured to secure two or more cylinders onto two or more cylinders.

It will also be understood that the above-described embodiments may be capable of processing cylinders longer (or shorter) in length than those depicted. For example, a double-length cylinder (relative to cylinders 2 of FIG. 1A and elsewhere) may be accommodated by using adjacent two stations 12 and two corresponding restraining arms 22 to secure the double-length cylinder.

In addition, whilst reference has been exclusively made to a locking mechanism as part of the HLU 30, it will be understood that alternative non-hydraulic components may serve the same purpose. For example, in alternative embodiments the restraining arms may be prevented from movement by means of electromagnetic or mechanical locking mechanisms.

The plurality of restraining arms 22 in the above-described embodiments move rotationally between the open and closed configuration. In an alternative, the restraining arms could be configured to move between the open and closed position through a linear movement, or a movement having both linear and rotational components. For the sake of example, a linear movement could be generated by a rotating screw, configured to advance for the restraining arm to contact a cylinder in a restraining fashion at one end of the restraining arm.

Whilst not shown in the above-described embodiments, the linkage arrangement between at least one of the plurality of restraining arms, the respective HLU and the rotary frame may further comprise a load cell. The load cell may be configured to measure mechanical stresses (e.g. tension or compression) in the linkage arrangement. In an example, the load cell may be an S-type strain gauge. The load cell may be situated at any appropriate position within the linkage arrangement. In an example, the load cell may be mounted in-line with the coupling rod (shown in dashed lines as 53 on coupling rod 52 in FIG. 2).

It will be understood that the linkage arrangement may have a degree of play or backlash. This backlash may be prejudicial against effective restraint of the cylinders. For example, when the locking mechanism is in a locked configuration, backlash may permit a small amount of movement in one or more of the plurality of restraining arms—this may result in any cylinder being retained by a relevant restraining arm being able to move by a small amount, which may be undesirable.

In order to mitigate the potential effects of linkage arrangement backlash, the linkage arrangement may further comprise spring-loaded pivots configured to take-up any backlash by means of pre-loading the linkage. For example, a spring-loaded pivot may be disposed along one or more of the restraining arms. In use, an operator may pull the yoke down onto a cylinder (the restraining arm is thereby being moved into its closed configuration), securing the cylinder against the respective bed. The springs of the spring-loaded pivot are compressed. The restoring forces of the spring-loaded pivot will act to urge the relevant restraining arm against the cylinder and take up any backlash in the linkage arrangement (i.e. preloading the linkage). In this way movement of the linkage arrangement and hence restraining arm and restrained cylinder when the locking mechanism is in a locked configuration is prevented. It will be appreciated that the preload will result in a compressive stress in the coupling rod.

The spring-loaded pivot may comprise a pivot coupled to an offset coil spring (or any other biasing means), configured to oppose rotation of the pivot. In some embodiments, the spring-loaded pivot may comprise two or more springs.

In embodiments where a load cell is mounted in-line with the coupling rod, the load cell may measure the preload (i.e. as indicated by the compressive stress in the coupling rod). It will be appreciated that the magnitude of the preload will be determined by the degree to which the spring in the pivot is compressed. The load cell may be linked to a PLC configured to compare the measured compression to predetermined values. For example, if the compression is within a predetermined range of acceptable values, the PLC may be configured to indicate this to the operator, by visual means or otherwise. If the compression is outside the predetermined range of acceptable values, the PLC may be configured to output an alarm and inform the operator. The predetermined range of acceptable values may be at least partially defined by the minimum value for effective restraint of the cylinders. As such, if the PLC indicates to the operator that the compression is within a predetermined range of acceptable values, the operator may be reassured that the relevant cylinder is effectively restrained by the restraining arm. Conversely, if the PLC indicates to the operator that the compression is not within a predetermined range of acceptable values, the operator may be informed that the relevant cylinder is not effectively restrained by the restraining arm and that action needs to be taken to correct this.

The predetermined range of compression values may be different for different cylinder geometries and sizes. On identification of a cylinder type (e.g. by SKU code or otherwise), the PLC may be configured to select the appropriate predetermined range for that particular cylinder type.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be considered as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A processing apparatus for a plurality of cylinders, the processing apparatus comprising:

a superstructure comprising a support frame;

a rotary structure mounted to the support frame for rotation about a rotational axis, the rotary structure comprising a plurality of cylinder stations, angularly spaced about the rotational axis, each configured, in use, to receive a cylinder;

a plurality of restraining arms, each restraining arm corresponding to a respective cylinder station, wherein each restraining arm is moveable between:

a closed configuration in which, in use, the restraining arm contacts a cylinder received on the corresponding cylinder station to restrain the cylinder on the cylinder station; and an open configuration in which, in use, the restraining arm is retracted away from said cylinder received on the corresponding cylinder station such that a cylinder can be removed from the cylinder station or placed on the cylinder station; and a locking mechanism coupled to the plurality of restraining arms, the locking mechanism having:

an unlocked configuration in which movement of the plurality of restraining arms between said closed and open configurations is possible; and a locked configuration in which movement of the plurality of restraining arms from said closed configuration to said open configuration is prevented by the locking mechanism.

2. The processing apparatus of claim 1, wherein the processing apparatus has one of 2, 3, 4, 5, 6, 7, 8, 9, 10, 11, 12, 13, 14, 15 or 16 cylinder stations.

3. The processing apparatus of claim 1, wherein the rotary structure further comprises a rotary frame, supporting the cylinder stations.

4. The processing apparatus of claim 3, wherein the plurality of restraining arms are coupled to the rotary frame.

5. The processing apparatus of claim 1, wherein the movement of the plurality of restraining arms between said closed and open configurations comprises a rotation.

6. The processing apparatus of claim 1, wherein the movement of the plurality of restraining arms between said closed and open configurations comprises a linear motion.

7. The processing apparatus of claim 1, wherein the locking mechanism further comprises one or more locking transducers.

8. The processing apparatus of claim 7, wherein each of the one or more locking transducers is coupled to two or more restraining arms.

9. The processing apparatus of claim 1, wherein each of the plurality of restraining arms exerts a restraining force on a cylinder received, in use, on the respective cylinder station, when the locking mechanism is in the locked configuration; wherein the restraining force is less than a buckling force of the cylinder.

10. The processing apparatus of claim 1, wherein the processing apparatus is configured to carry out hydrostatic testing on said plurality of cylinders.

11. The processing apparatus of claim 10, wherein the processing apparatus further comprises a hydrostatic testing module, said hydrostatic testing module comprises:

filling apparatus configured to be secured to at least one opening of each cylinder and to introduce water into each cylinder and pressurize said introduced water; and a pressure monitoring apparatus configured to measure a pressure within each of said plurality of cylinders when filled with said introduced water.

12. The processing apparatus of claim 1, wherein the processing apparatus is configured to carry out pickling operations.

13. The processing apparatus of claim 12, wherein each restraining arm includes a filling portion configured to inserted, in use, into one or more openings provided in the cylinder located on the respective cylinder station, wherein the filling portion is configured to provide a fluid connection to a source of pickling fluid, so as to introduce pickling solution into the cylinder.

14. The processing apparatus of claim 1, wherein each restraining arm comprises a main body and a yoke located at a distal end of the main body, the yoke being configured to contact at least a portion of an outer surface of a cylinder received on the respective cylinder station when the restraining arm is in the closed configuration.

15. The processing apparatus of claim 14, wherein the yoke of each restraining arm is pivotably mounted to the main body.

16. The processing apparatus of claim 1, wherein the locking mechanism enters the unlocked configuration from the locked configuration when energised.

17. The processing apparatus of claim 16, wherein the locking mechanism passively adopts the locked configuration on de-energisation.

18. A method of carrying out a processing operation on a plurality of cylinders using a processing apparatus, the processing apparatus comprising:

a superstructure comprising a support frame;

a rotary structure mounted to the support frame, the rotary structure comprising a plurality of cylinder stations, angularly spaced about a rotational axis, and a plurality of restraining arms, each restraining arm corresponding to a respective cylinder station, and a locking mechanism coupled to the plurality of restraining arms;

wherein the method comprises:

rotating the rotary structure relative to the support frame about the rotational axis, receiving a cylinder on each cylinder station;

moving each restraining arm between:

a closed configuration in which, in use, the restraining arm contacts a cylinder received on the corresponding cylinder station to restrain the cylinder on the cylinder station; and an open configuration in which, in use, the restraining arm is retracted away from said cylinder received on the corresponding cylinder station such that a cylinder can be removed from the cylinder station or placed on the cylinder station;

changing the state of the locking mechanism between:

an unlocked configuration in which movement of the plurality of restraining arms between said closed and open configurations is possible; and a locked configuration in which movement of the plurality of restraining arms from said closed configuration to said open configuration is prevented by the locking mechanism;

carrying out a processing operation on each cylinder.

19. The method of carrying out a processing operation on a plurality of cylinders of claim 18 using the processing apparatus, the processing apparatus further comprising:

a hydrostatic testing module, the hydrostatic testing module comprising filling apparatus for the plurality of cylinders; and a pressure monitoring apparatus for each of said plurality of cylinders;

wherein the method further comprises:

securing the filling apparatus to at least one opening of each cylinder;

the filling apparatus introducing water into each cylinder;

the filling apparatus pressurising said introduced water;

the pressure monitoring apparatus measuring a pressure within each of said plurality of cylinders, when water has been introduced into each cylinder and pressurized, over a period of time;

draining the water from the cylinder.

20. The method of carrying out a processing operation on a plurality of cylinders of claim 18 using the processing apparatus, the processing apparatus further comprising:

a filling portion, coupled to each restraining arm;

wherein the method further comprises:

inserting each filling portion into one or more openings provided in a cylinder located on the respective cylinder station;

providing a fluid connection between each filling portion and a source of pickling fluid;

introducing pickling solution from the source of pickling solution into each cylinder via the respective filling portion and said fluid connection;

allowing the pickling solution to react with each cylinder, whilst the rotary structure is rotated to agitate said introduced pickling solution;

draining the pickling solution from each cylinder.

21. The method of claim 18, wherein the method further comprises, loading each of the plurality of cylinders, so as to be received by the respective cylinder station, whilst the respective restraining arm is in the open configuration.

22. The method of claim 18, wherein the method further comprises unloading each of the plurality of cylinders from the respective cylinder station, whilst the respective restraining arm is in the open configuration.

* * * * *